US008539618B2

(12) United States Patent
Gibson et al.

(10) Patent No.: US 8,539,618 B2
(45) Date of Patent: Sep. 24, 2013

(54) DRAIN COVER FOR SINKS

(75) Inventors: Jeffrey John Gibson, London (CA); Joe Malheiro, London (CA); Frank A. Stauder, London (CA)

(73) Assignee: Masco Canada Limited, London, Ontario (CA)

( * ) Notice: Subject to any disclaimer, the term of this patent is extended or adjusted under 35 U.S.C. 154(b) by 218 days.

(21) Appl. No.: 12/843,084

(22) Filed: Jul. 26, 2010

(65) Prior Publication Data

US 2011/0023221 A1 Feb. 3, 2011

Related U.S. Application Data

(60) Provisional application No. 61/229,828, filed on Jul. 30, 2009.

(51) Int. Cl.
*A47K 1/14* (2006.01)

(52) U.S. Cl.
USPC ..... 4/293

(58) Field of Classification Search
USPC ..... 4/286–293
See application file for complete search history.

(56) References Cited

U.S. PATENT DOCUMENTS

| | | | | |
|---|---|---|---|---|
| 471,578 | A | | 3/1892 | Strater |
| 978,913 | A | | 12/1910 | Madden |
| 3,366,980 | A | | 2/1968 | Petursson et al. |
| 4,176,684 | A | | 12/1979 | Kelso et al. |
| 5,452,484 | A | * | 9/1995 | Hill ..... 4/658 |
| 6,058,526 | A | | 5/2000 | Parisi et al. |
| 6,219,861 | B1 | | 4/2001 | Chen |
| 6,698,035 | B1 | | 3/2004 | Grueser |

OTHER PUBLICATIONS

Canadian Office Action dated Apr. 4, 2013 for Canadian Application No. 2,711,609.

* cited by examiner

*Primary Examiner* — Lori Baker
(74) *Attorney, Agent, or Firm* — Carlson, Gaskey & Olds P.C.

(57) ABSTRACT

An apparatus includes a drain having an opening, the opening having an outboard edge, a cover having an underside having a portion including a downwardly extending curved section and an outer edge, wherein the portion extends a first distance beyond the outboard edge and wherein cover extends a second distance above the drain such that a ratio of the second distance to the first distance is about 1 or less and such that splash and aerosolization from under the cover beyond the cover is minimized.

15 Claims, 3 Drawing Sheets

DRAIN COVER FOR SINKS

RELATED APPLICATION

This application claims priority to U.S. Provisional Patent Application 61/229,828 filed on Jul. 30, 2009.

BACKGROUND OF THE INVENTION

Drains used in many commercial applications, such as in hospitals, are either open or have a fixed, flat strainer as a covering. In some instances, a water stream from above is aligned with the drain.

Drains may host biofilms and other organisms, particularly those that like moisture.

SUMMARY OF THE INVENTION

According to an exemplar described herein, an apparatus has a drain having an opening, the opening having an outboard edge, a cover having an underside having a portion including a downwardly extending curved section and an outer edge, wherein the portion extends a first distance beyond the outboard edge and wherein cover extends a second distance above the drain such that a ratio of the second distance to the first distance is about 1 or less and such that splash and aerosolization from under the cover beyond the cover is minimized.

According to a further exemplar described herein, an apparatus has an opening, the opening having an outboard edge, a cover having an underside having a portion including a downwardly extending curved section and an outer edge, wherein the portion extends a first distance beyond the outboard edge and wherein cover extends a second distance above the drain such that splash and aerosolization from under the cover beyond the cover is minimized.

DETAILED DESCRIPTION OF THE PREFERRED EMBODIMENT

Figure 1:
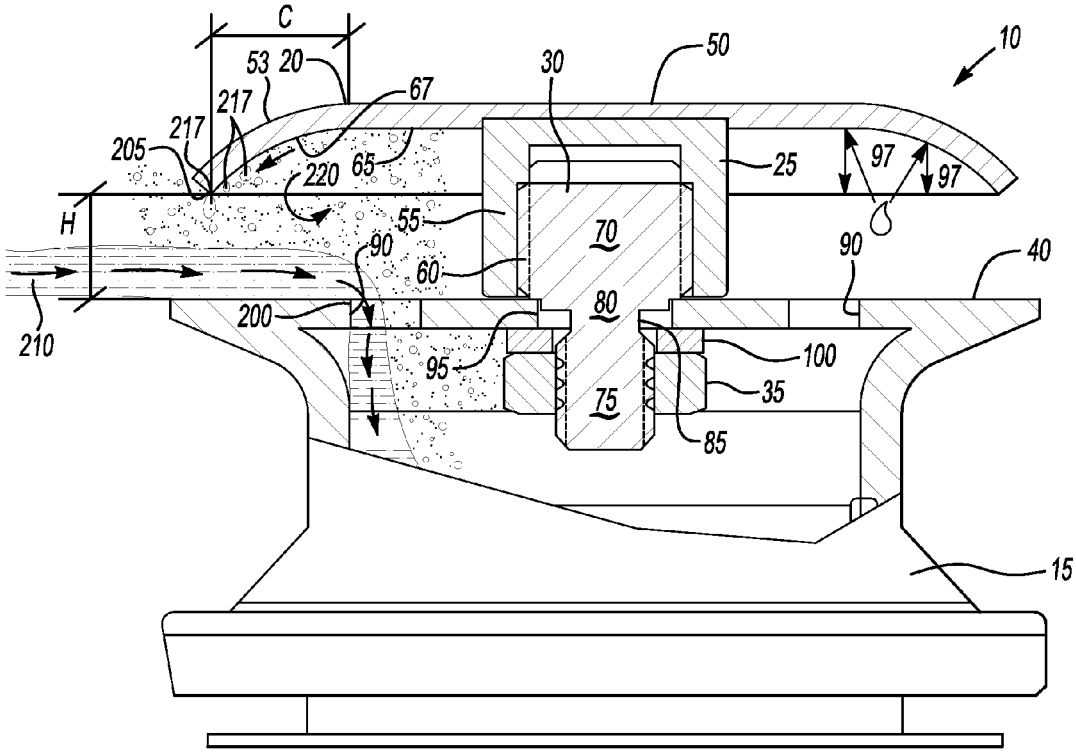
FIG. 1 shows a perspective view of a first embodiment of the drain cover of the invention.
Figure 1A:
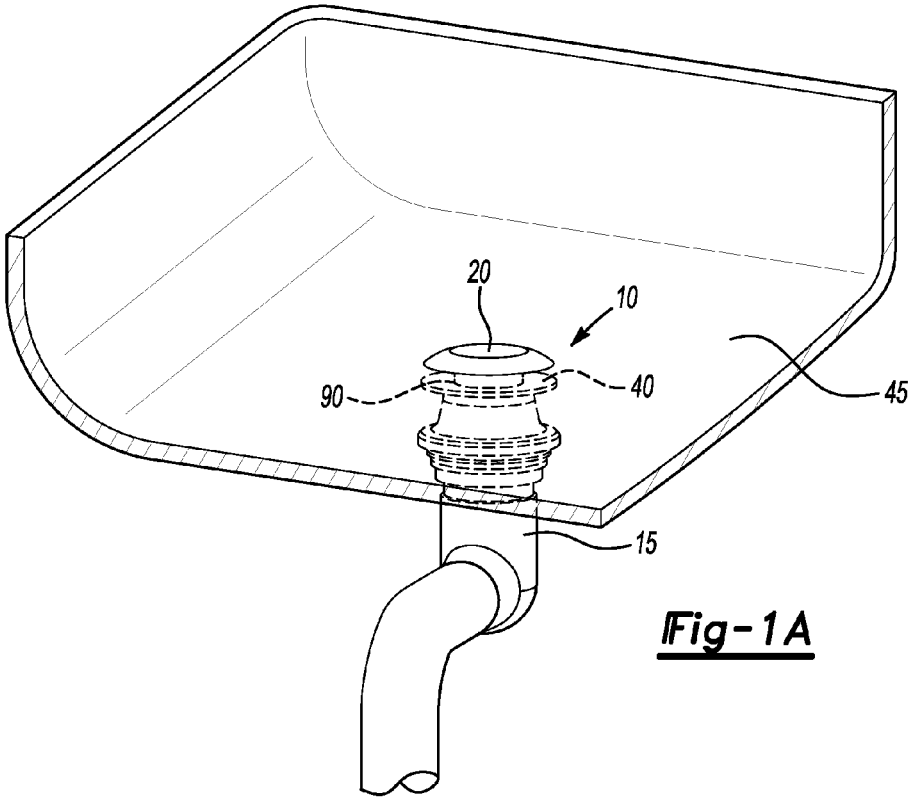
FIG. 1A shows a perspective, partially cut-away view of the drain cover of FIG. 1 disposed over a drain.

Referring now to FIGS. 1 and 1A, the drain cover 10 of the invention is shown for use over drain 15. The drain cover comprises a cover 20, a first nut 25 conventionally attaching to the cover 20, and a bolt 30 which is received in the first nut 25, and a second nut 35 attaching to the bolt 30 below a strainer 40. The drain cover 10 is mounted in a sink 45 or other enclosure.

The cover 20 has a flat top 50 and a downwardly-curved rim 53 and is constructed of metal or plastic. The first nut 25 has a cylindrical body 55 that extends downwardly from a bottom surface 65 of the cover 20 and has an internal thread 60. If the cover 20 and first nut 25 are metal, like brass, the parts are brazed together and if they are plastic, they are conventionally attached by gluing, sonic welding or the like.

The bottom surface 65 has a curved portion 67 that may begin to curve near or beyond the outside edge 200 of the drain hole 90 for a distance C to its outside inner edge 205. The outside inner edge is disposed a distance H above the strainer 40. Given draining requirements and normally expected flow rates of fluid 210, such as water, in the sink 45, a ratio of H to C is about less than or equal to 1. Though the curved portion 67 begins nearly over the outside edge 200 of the drain hole 90 in this embodiment, the curved portion may begin at other positions inside or outside of the drain 115 (see curved portion 167 in FIG. 5).

The bolt 30 has a larger diameter portion 70 that is threaded, an axially displaced smaller diameter portion 75 (relative to the larger diameter area 55) that is also threaded and an intermediary portion 80 having a diameter 85 that is smaller than the larger diameter portion 70 and larger than the smaller diameter portion 75 located between the larger diameter portion 70 and the smaller diameter portion 75.

Figure 4:
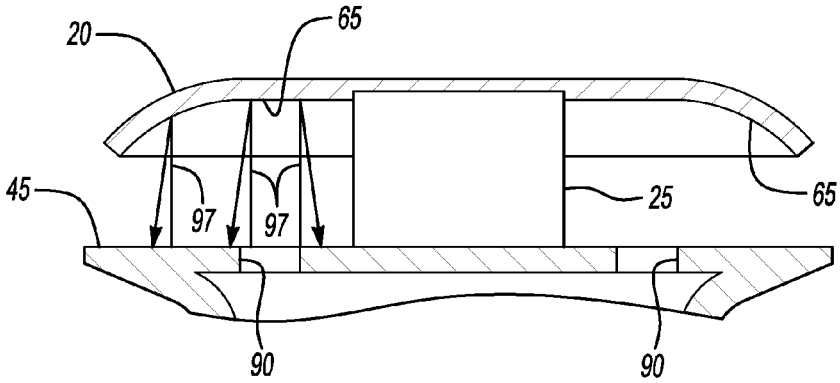
FIG. 4 shows a cutaway, perspective view of the drain of FIG. 1A.

The strainer 40 has a plurality of drain holes 90 and a central opening 95 for cooperating with the bolt 30 as will be discussed herein. Referring to FIG. 4, the drain holes 90 are located within a diameter of the cover 20 so that any splashing 97 from the drain 15 or the strainer 40 are caught by the bottom surface 65 and curved portion 67 and are redirected downwardly to the drain 15 which flows to the strainer 40 or to the strainer 40 and its holes 90 for disposal therethrough. As such any splashing from the drain 15 or the strainer 40 to the sink 45 is minimized.

In order to install the drain cover 10, a user inserts the bolt 30 through the opening 95 in the strainer 40, places a washer 100 over the smaller diameter portion 75 and threads the second nut 35 over the smaller diameter portion 75 of the bolt to tighten the larger diameter portion 70 against the strainer. A user then threads the cylindrical body 55 and its threaded portion 60 over the threaded larger diameter portion 70 of the bolt 30 until the cylindrical body 55 abuts the strainer 40. In order to allow access for cleaning of the strainer 40, which may host pathogens or the like therein, a user simply unscrews the bolt cover 20 and the cylindrical body 55 from the bolt 30.

Figure 2:
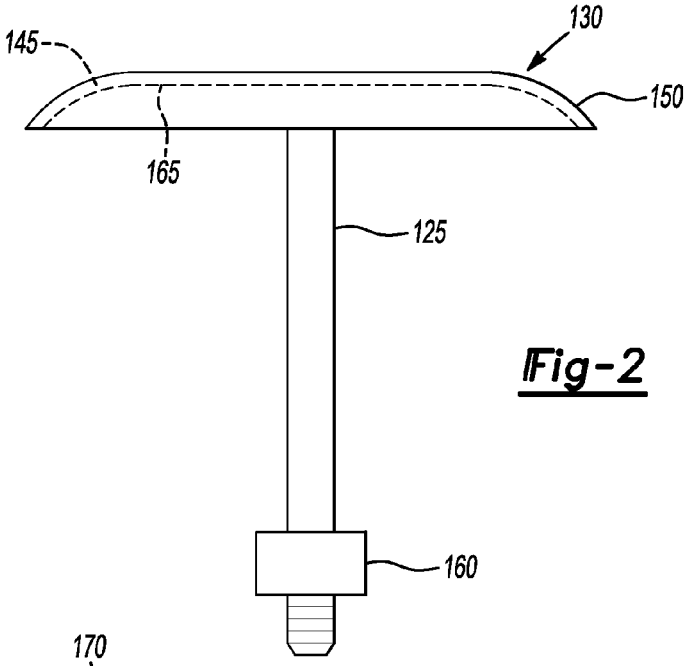
FIG. 2 shows a second embodiment of the drain cover of the invention.
Figure 3:
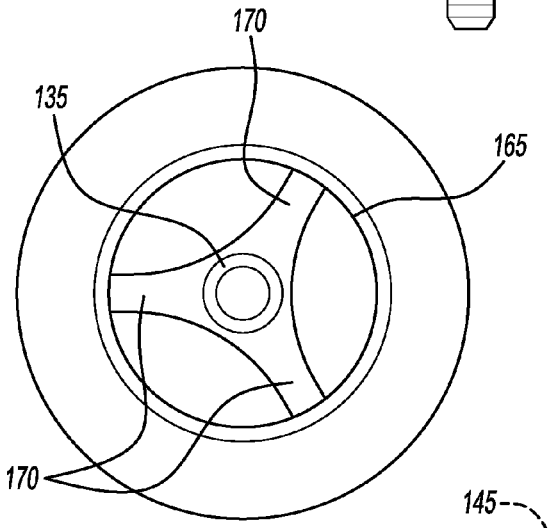
FIG. 3 shows a top view of a mounting support for the drain cover of FIG. 2.
Figure 3A:
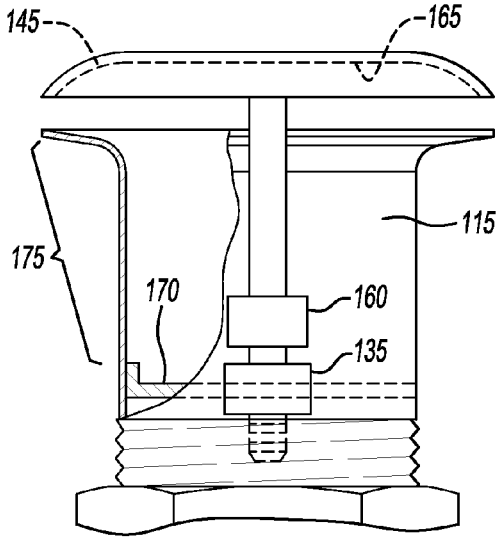
FIG. 3A shows a perspective cut-away view of the mounting support of FIG. 3 in a drain.

According to a second embodiment, and referring to FIGS. 2, 3, and 3A, a 130 cover has a flat top 145 and a downwardly-curved cover 150 and is constructed of metal or plastic. A bolt 125 extends upwardly to the cover 130 and downwardly to a nut 135 disposed in the drain 115. To install or remove the cover 130, a user may screw or unscrew the bolt 125 in or from the nut 135.

The bolt has an area 160 of increased diameter that limits penetration of the bolt into the nut 135 so that the cover 130 is at the proper height above a drain 115 (see FIGS. 3 and 3A). The cover 130 extends over the edges of the drain 115 (see FIG. 3A). When attaching the cover 130, the bolt 125 is limited from passing too far within the nut 135 by the area of expanded diameter. The opening includes a group of struts 170 that hold the nut 135 at a center thereof at a depth 175 within the drain 115.

By disposing the nut 135 at a depth within the drain 115, removal of the cover 130 allows a portion of the drain 115 to be cleaned of biofilms and any pathogens or the like therein. A strainer (not shown) is not included and therefore fluid cannot splash from or on it. The drain 115 is located within a diameter of the cover 130 so that any splashing 97 from the drain 115 is caught by the bottom surface 165 has a curved portion 167 curves with the cover 150 and is redirected downwardly to the drain 115 for disposal therethrough. As such any splashing 97 from the drain to the sink 45 is minimized. As stated herein above, a ratio of H (the height of the outside inner edge 205 above the sink 45) to C (the distance from the outside edge 200 of the drain 15 to the outside inner edge 205 of the bottom surface 165) is about less than or equal to 1. In other words, C (the distance from the outside edge 200 of the drain 15 to the outside inner edge 205 of the bottom surface 165) is greater than or equal to H (the height of the outside inner edge 205 above the sink 45).

Figure 5:
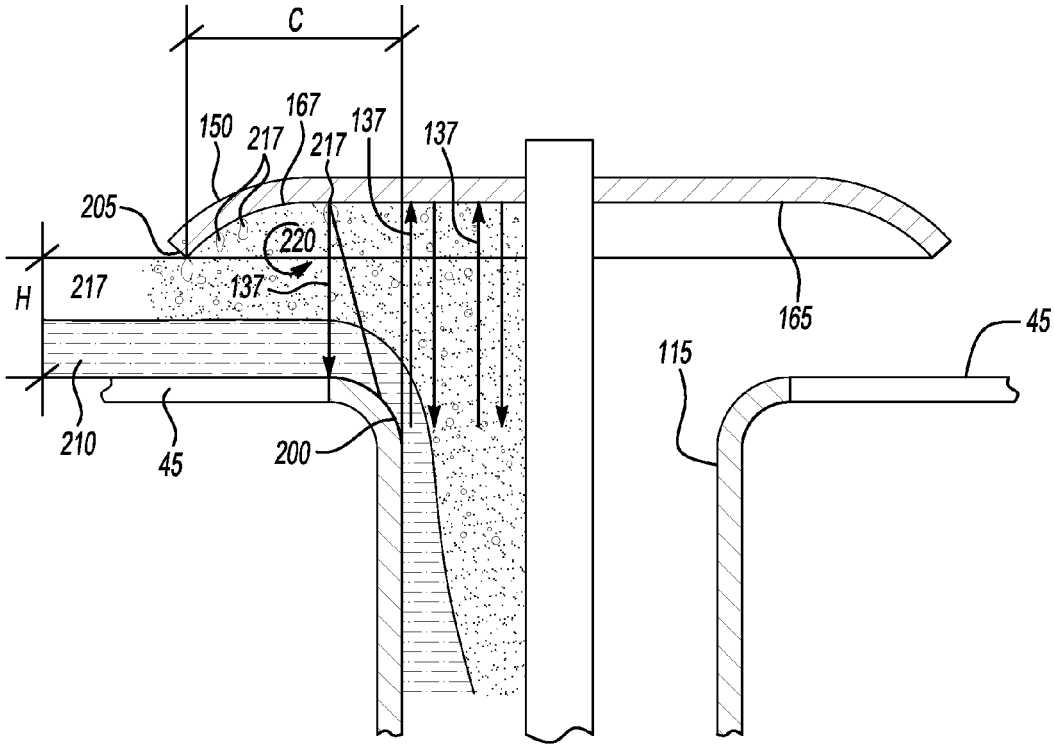
FIG. 5 shows a cutaway, perspective view of the drain of FIG. 3A.

Referring to FIGS. 1 and 5, as fluid 210 flows into the drains 15 and 115, there is a normal misting or aerosolization of fluid particles 220 that may include pathogens or the like. The aerosolized fluid particles 220 tend to condense or form droplets 217 on the bottom of the covers 20, 150 that fall to the drains 15, 115 or flow down the curved portions 67, 167 and drop into the fluid 210 for disposition in the drains 15, 115. The curvature of the bottom surfaces may act to minimize the flow of fluid particles 220 from below the covers 20, 150 to ambient.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content. One of ordinary skill in the art will recognize that other embodiments of this invention may be gleaned herefrom. For instance, the cover 30 may form different shapes.

What is claimed is:

1. A drain apparatus for use with a sink, said drain apparatus comprising;

a drain having an opening, said opening having an outboard edge, a cover covering said drain opening, said cover for extending completely above said sink and having an underside having a portion including a downwardly extending curved section and an outer edge, wherein said portion extends a first distance beyond said outboard edge and wherein said cover extends a second distance above said drain wherein said first distance is greater than or equal to said second distance and such that splash and aerosolization of fluid from under said cover beyond said cover is minimized; said cover having a first nut attaching thereto and extending downwardly therefrom;

a second nut, a bolt, and a drain strainer for covering said drain, said drain strainer having an opening and a drain hole wherein said bolt extends through said opening to engage said first nut and to engage said second nut to attach said cover to said drain strainer and wherein said underside and said downwardly extending rim cooperate such that splash from said strainer beyond said cover is minimized.

2. The drain apparatus of claim 1 wherein said bolt further comprises:

a first threaded portion of larger dimension for engaging said first nut, a second threaded portion of smaller dimension relative to said larger dimension for engaging said second nut, and an intermediate portion between said larger portion and said smaller portion for engaging said strainer wherein said if said second nut is tightened said first threaded portion of larger dimension touches said strainer.

3. The drain apparatus of claim 2 wherein if said first nut is threaded on said first threaded portion of larger dimension said first nut engages said strainer.

4. A drain apparatus for use with a sink, said drain apparatus comprising;

a drain having an opening, said opening having an outboard edge, a cover covering said drain opening, said cover for extending completely above said sink and having an underside having a portion including a downwardly extending curved section and an outer edge, wherein said portion extends a first distance beyond said outboard edge and wherein said cover extends a second distance above said drain wherein said first distance is greater than or equal to said second distance and such that splash and aerosolization of fluid from under said cover beyond said cover is minimized;

a support for disposition within said drain and holding a nut in a central location therein;

a bolt having a first end disposed in and extending through said cover and having a length and a threaded portion at second end thereof, distal from said cover, said bolt further comprising a depth limiter, wherein if said threaded portion is threaded into said nut, said depth limiter positions said bolt such that said cover is in position in said drain.

5. The cover of claim 4 wherein said support is a strainer.

6. The cover of claim 4 wherein said support is a plurality of struts disposed within said drain.

7. The cover of claim 4 wherein said first end may be manipulated to screw and unscrew said bolt into said nut.

8. An apparatus comprising;

a drain having an opening, said opening having an outboard edge;

a cover covering said drain and having an underside having a portion including a downwardly extending curved section and an outer edge, wherein said portion extends a first distance beyond said outboard edge and wherein said cover extends a second distance above said drain such that splash and aerosolization of fluid from under said cover beyond said cover is minimized said cover having:

a first nut attaching thereto and extending downwardly therefrom;

a second nut;

a bolt; and a drain strainer for covering said drain, said drain strainer having an opening and a drain hole wherein said bolt extends through said opening to engage said first nut and to engage said second nut to attach said cover to said drain strainer and wherein said underside and said downwardly extending rim cooperate such that splash from said strainer beyond said cover is minimized.

9. The drain apparatus of claim 8 wherein said bolt further comprises:

a first threaded portion of larger dimension for engaging said first nut, a second threaded portion of smaller dimension relative to said larger dimension for engaging said second nut, and an intermediate portion between said larger portion and said smaller portion for engaging said strainer wherein said if said second nut is tightened said first threaded portion of larger dimension touches said strainer.

10. The drain apparatus of claim 9 wherein if said first nut is threaded on said first threaded portion of larger dimension said first nut engages said strainer.

11. A drain apparatus for use with a sink, said drain apparatus comprising;

a drain having an opening, said opening having an outboard edge;

a cover covering said drain opening and having an underside having a portion including a downwardly extending curved section and an outer edge, wherein said portion extends a first distance beyond said outboard edge and wherein said cover extends a second distance above said drain such that splash and aerosolization of fluid from under said cover beyond said cover is minimized;

a support for disposition within said drain and holding a nut in a central location therein;

a bolt having a first end disposed in and extending through said cover and having a length and a threaded portion at second end thereof, distal from said cover, and said bolt further comprising a depth limiter, wherein if said threaded portion is threaded into said nut, said depth limiter positions said bolt such that said cover is in position in said drain.

12. The cover of claim 11 wherein said support is a strainer.

13. The cover of claim 11 wherein said support is a plurality of struts disposed within said drain.

14. The cover of claim 11 wherein said first end may be manipulated to screw and unscrew said bolt into said nut.

15. A drain apparatus, said drain apparatus comprising;

a sink, a drain in said sink, said drain having an opening, said opening having an outboard edge, a cover covering said drain opening, said cover extending completely above said sink and having an underside having a portion including a downwardly extending curved section and an outer edge, wherein said portion extends a first distance beyond said outboard edge and wherein said cover extends a second distance above said drain such that a ratio of said second distance to said first distance is about 1 or less wherein said first distance is greater than or equal to said second distance and such that splash and aerosolization of fluid from under said cover beyond said cover is minimized.

* * * * *